US007822174B2

(12) United States Patent
Le Gros et al.

(10) Patent No.: US 7,822,174 B2
(45) Date of Patent: Oct. 26, 2010

(54) CRYOTOMOGRAPHY X-RAY MICROSCOPY STATE

(75) Inventors: Mark Le Gros, Berkeley, CA (US); Carolyn A. Larabell, Berkeley, CA (US)

(73) Assignee: The Regents of the University of California, Oakland, CA (US)

( * ) Notice: Subject to any disclaimer, the term of this patent is extended or adjusted under 35 U.S.C. 154(b) by 362 days.

(21) Appl. No.: 11/911,960

(22) PCT Filed: Apr. 20, 2006

(86) PCT No.: PCT/US2006/015140

§ 371 (c)(1),
(2), (4) Date: Oct. 18, 2007

(87) PCT Pub. No.: WO2006/113908

PCT Pub. Date: Oct. 26, 2006

(65) Prior Publication Data

US 2009/0129543 A1 May 21, 2009

Related U.S. Application Data

(60) Provisional application No. 60/673,017, filed on Apr. 20, 2005.

(51) Int. Cl.
*G21K 7/00* (2006.01)
*G01N 23/04* (2006.01)

(52) U.S. Cl. ..... 378/43; 378/62

(58) Field of Classification Search ..... 378/4, 378/43, 85, 145, 41, 79–81, 62
See application file for complete search history.

(56) References Cited

U.S. PATENT DOCUMENTS 4,661,968 A * 4/1987 Wondergem ..... 378/79
5,245,648 A * 9/1993 Kinney et al. ..... 378/43

OTHER PUBLICATIONS

Maser, J., et al., "Soft X-ray Microscopy with a Cryo Scanning Transmission X-ray Microscope: I. Instrumentation, Imaging and Spectroscopy", Journal of Microscopy, vol. 197, pp. 68-79, (Jan. 2000).
Meyer-Ilse, W., et al., "High Resolution Protein Localization using Soft X-ray Microscopy", Journal of Microscopy, vol. 201, Pt 3, pp. 395-403, (Mar. 2001).
Schneider, "X-ray Microscopy: Methods and Perspectives", Analytical Bioanalytical Chemistry, vol. 376, pp. 558-561, (Jun. 17, 2003).
Schneider, "Cryo X-ray Microscopy with High Spatial Resolution in Amplitude and Phase Contrast", Ultramicroscopy, vol. 75, pp. 85-104, (1998).
Wang, Y., et al., "Soft X-ray Microscopy with a Cryo Scanning Transmission X-Ray Microscope: II. Tomography", Journal of Microscopy, vol. 197, pp. 80-93, (Jan. 2000).
Weib, D., et al., "Tomographic Imaging of Biological Specimens with the Cryo Transmission X-ray Microscope", Nuclear Instruments and Methods in Physics Research A, vol. 467-468, pp. 1308-1311, (2001).

* cited by examiner

*Primary Examiner*—Irakli Kiknadze
(74) *Attorney, Agent, or Firm*—Fulbright & Jaworski LLP

(57) ABSTRACT

An x-ray microscope stage enables alignment of a sample about a rotation axis to enable three dimensional tomographic imaging of the sample using an x-ray microscope. A heat exchanger assembly provides cooled gas to a sample during x-ray microscopic imaging.

23 Claims, 14 Drawing Sheets

CRYOTOMOGRAPHY X-RAY MICROSCOPY STATE

CROSS-REFERENCE TO RELATED APPLICATIONS

This application claims priority to U.S. Patent Provisional Application 60/673,017, filed Apr. 20, 2005, and is a U.S. National Phase filing of Patent Application PCT/US2006/15140, filed Apr. 20, 2006, both of which are incorporated by reference herein. This application is also related to Patent Application PCT/US200615162, filed Apr. 20, 2006.

STATEMENT OF GOVERNMENT INTEREST

The invention described and claimed herein was made in part utilizing funds supplied by the U.S. Department of Energy under Contract Number DE-AC03-76SF00098 and by the National Institutes of Health under Grant Number R01 GM63948-03. The U.S. government has certain rights in this invention.

TECHNICAL FIELD

The present invention relates generally to the field of microscopy, and, more specifically, to a precision specimen stage for use with high resolution x-ray microscopy.

BACKGROUND ART

Among the most commonly used microscopic techniques for imaging whole cells or other materials in biology or materials science are UV-visible light microscopy or transmission electron microscopy (TEM). UV-visible light microscopy has the advantage of being able to image under ambient conditions and thus able to image dynamic processes such as cell dynamics. However, UV-visible light microscopy has limited resolution. TEM provides excellent resolution, however, in the case of biological samples, extensive preprocessing is required and the imaging must be done under vacuum. In the case of imaging cells with TEM, the cells usually must be dehydrated, embedded in plastic, and then ultra thin sections (10-100 nm) of the cells must be prepared for separate imaging owing to the limited depth of focus when using electrons.

Recently, microscopic imaging using soft x-rays has shown promise. Samples have been imaged using soft x-rays using both scanning transmission x-ray microscopy (STXM), where a sample is rastered through the source beam and the intensity of x-rays transmitted through the sample is measured point-by-point, and transmission x-ray microscopy (TXM), where full field transmission of x-rays through a sample is detected using a CCD (charge-coupled device) camera. Imaging of whole cells with soft x-rays may be accomplished by rapid freezing of fully hydrated cells. Thus, no preprocessing is required as in TEM, and high resolution approaching 20 nm can be obtained.

Owing to the need that samples in x-ray microscopy be cryogenically frozen and maintained, x-ray microscope stages require a means for continuous cooling of the sample. Previous methods have included placing a liquid nitrogen bath below the sample, thermal conduction from a liquid nitrogen bath to the sample holder, or providing a stream of liquid nitrogen cooled helium gas to the sample. These methods lack precise temperature control and may require gas stream rates that could disturb the sample during imaging. Thus, there is a need for improved cryogenic x-ray microscope stages.

Three-dimensional imaging of samples has been accomplished using light, TEM, and x-ray microscopic techniques. For example, 3D imaging using light microscopy has been conducted using confocal, two-photon confocal, through-focus deconvolution, and interferometric methods. In the case of TEM, individually imaged sections can be reconstructed to produce a 3D image. In the case of x-ray microscopy, 3D images can be constructed using computed tomography. Tomography has been accomplished with x-ray microscopy by taking a series of images (either using STXM or TXM) at different sample tilt angles. In order for the computed tomography algorithms to function properly, the images must be aligned relative to the same rotation axis. Previously, such alignment has been accomplished by either re-aligning the sample between each image or by including fiducial markers with the sample and then using a 3D marker module to align the images. However, these techniques require tedious and time-consuming manual procedures and may introduce additional error into the resulting image. Additionally, the use of fiducial markers may interfere with the sample. Accordingly, fast and automated sample alignment for tomographic x-ray microscopy is needed.

DISCLOSURE OF INVENTION AND BEST MODE FOR CARRYING OUT THE INVENTION

In one embodiment, an x-ray microscope stage is provided that allows accurate alignment of a sample relative to a rotation axis. In some embodiments, once aligned, the sample can be accurately rotated about the rotation axis with little deviation from the axis in order to allow precise imaging for computed tomography without the need to adjust the alignment of each image. In some embodiments, the stage allows for three-dimensional image acquisition in 10 minutes or less; in other embodiments, in 3 minutes or less. In some embodiments, the image acquisition is automated so that once the sample is aligned, the pressing of a single button or some other simple activation method results in three-dimensional image acquisition.

In another embodiment, an x-ray microscope stage is provided that provides a stream of a first cooled gas to maintain the sample at cryogenic temperatures. The first gas is cooled in a heat exchanger that is also in thermal contact with a second gas. The second gas may be flowed through the heat exchanger at a fast rate to provide efficient heat transfer from the first gas, thus allowing the first gas to be cooled rapidly. In contrast, the first gas may flow slowly so that it flows gently along the sample carrier or sample holder. The terms sample carrier and sample holder are used interchangeably throughout this disclosure. A gentle, perhaps non-turbulent, flow reduces the chance that the sample will be disturbed by the gas flow during image acquisition.

A typical x-ray microscopy configuration that can be used with the x-ray microscope stages described herein is depicted in FIG. 1. X-ray source radiation 100 is provided to sample 102. One or more Fresnel zone plate lenses 104 is used as an objective lens and the resulting image is detected by an x-ray sensitive CCD 106. In some embodiments, the x-ray source is a soft x-ray source with wavelengths between about 0.1 nm and 10 nm. In other embodiments, the x-ray source is a hard x-ray source with wavelengths between about 0.01 nm and 0.1 nm. In one embodiment, soft x-ray radiation within the "water window" is used, that is x-rays with a range of photon energies between the K-shell absorption edges of carbon (284 eV) and oxygen (543 eV). In this energy range, organic matter absorbs approximately an order of magnitude more strongly than water. Thus, within the "water window," x-rays are advantageous for imaging organic matter such as cells. In one embodiment, x-ray radiation 100 is generated using a synchrotron electron storage ring. In various embodiments, a bend magnet, undulator, wiggler, or other magnet configuration is used with the synchrotron to generate the x-ray radiation 100. In another embodiment, the x-ray radiation is produced by laser plasma sources. In some embodiments, the CCD 106 is a thin, back-illuminated slow scan CCD camera. In other embodiments, the CCD 106 can be replaced by a camera with appropriate photographic film.

FIG. 2 depicts another view of an x-ray microscope configuration. Incident x-ray radiation 150 is provided by a bend magnet on a synchrotron electron storage ring. Condenser optics are contained within a condenser zone plate (KZP) box 152, that receives incident x-ray radiation 150 and produces condensed x-ray radiation for illumination of the sample 154. The KZP box 152 contains a condenser zone plate 156 for condensing radiation 150. The KZP box 152 may also contain a central stop 158. A pin hole 160 at the tip of cone 162 in the KZP box 152 controls the aperture of the radiation incident onto the sample 154. A micro zone plate (MZP) box 164 contains imaging optics and CCD camera 166. The MZP box 164 contains a window 166 for receiving the x-ray radiation transmitted through the sample 154. The imaging optics in the MZP box 164 includes micro zone plate objective 168 and phase plate 170. The particular x-ray microscope configurations described herein are merely examples of many possible x-ray microscope configurations. It should be understood that any suitable x-ray source, optics, and detector may be used with the x-ray stages described herein. For example, while the x-ray microscopes described above are TXMs, STXMs can also be used with the x-ray stages described herein.

FIG. 3 depicts one embodiment of an x-ray microscope stage as used in conjunction with an x-ray microscope. The x-ray microscope comprises KZP box 152 and MZP box 164. KZP box 152 contains condenser optics 200 and 202 mounted on a coarse x,y adjustment and piezo driven flexure based shaker assembly 204. MZP box 164 contains MXP micro zone plate 168 and phase plate 170. The phase plate 170 is mounted to x,y,z microscope stage 206 for positioning the phase plate 170 and for positioning a sample relative to an imaging beam. The x,y,z, stage 206 is coupled to a harmonic rotation motor 208 for rotating the sample during tomographic imaging. The rotation motor 208 is coupled to a precision bearing 210 that allows for precision transfer of rotational motion from the rotation motor 208 to the sample. The precision bearing 210 is connected to a tilt stage 212. The tilt stage 212 comprises picomotors 214 that allow for adjustment of the tilt stage 212. The tilt stage 212 is coupled to a sample mount 215, which is adapted to hold a sample carrier 216, such as a capillary or a flat sample surface. Thus, the picomotors 214 are tilt motors coupled to the sample carrier of holder 216. The angle of the tilt stage 212 may be adjusted using the picomotors 214 such that when the rotation motor 208 rotates, the sample carrier 216 rotates about an axis through the center of the sample carrier 216 so that the sample carrier 216 does not wobble excessively through the rotation. The sample carrier 216 is bathed in a stream of cooled helium gas that flows out of gas outlet 218. A cryogen stored in cryogen vessel 220 and a mechanism for cooling the helium gas is described below.

FIG. 4 depicts a view of one embodiment of the x-ray microscope stage along the x-ray beam line. FIG. 4 is shown with the KZP box removed. Again, the x,y,z stage 206 is provided for positioning a sample relative to the imaging beam. The rotation motor 208 is provided for rotating the sample and is coupled to the x,y,z stage 206. The precision bearing 210 is coupled to the rotation motor 208. Tilt stage 212 is coupled to the bearing 210. In some embodiments, the tilt stage 212 may be any suitable commercially available optical component mounting stage, such as is typically used for adjusting the tilt of lenses, etc. The angle of the tilt stage 212 is controlled by precision motors 214. In one embodiment, the precision motors 214 are picomotors from New Focus™. The tilt stage 212 is coupled to sample mount 215, to which a sample carrier 216 such as a capillary may be attached. A heat exchanger assembly 250 provides a cooled gas, such as helium, for cooling the sample and the sample carrier 216. A cryogen vessel 220 provides a cooling source for use with the heat exchanger assembly 250.

In some embodiments, the x-ray microscope stage may comprise a window selector for selecting various windows through which the sample may be viewed. For example, a window 252 is depicted in FIG. 4. The window 252 may be made of any materials appropriate for use with x-ray imaging, visible imaging, UV imaging, or any other suitable imaging technique. In one embodiment, a window selector 306, such as that depicted in FIG. 5, comprises a slide assembly 300 that contains two or more windows along the slide assembly. For example, an x-ray window 302 and an optical window 304 may be provided. The windows 302 or 304 may be selected by sliding slide assembly 300 so that the selected window 302 or 304 is adjacent the sample carrier 216. When optical window 304 is selected, an optical microscope may be used for imaging the sample. In one embodiment, optical imaging may be used to align the sample carrier 216.

In one embodiment, three dimensional imaging of a sample is performed using an x-ray microscope and computed tomography. The sample carrier is adjusted prior to image acquisition so that when the sample carrier is rotated, the rotation axis is aligned with the central axis of the sample carrier. The adjustment may be conducted using a tilt stage whose tilt angle may be adjusting using precision motors such as picomotors. In one embodiment, the tilt stage allows adjustment of the angle of the sample carrier relative to the axis of rotation of the precision bearing that is coupled to the rotation motor. In another embodiment, the tilt stage further comprises an x,y stage for moving the axis of the sample carrier laterally relative to the axis of rotation of the precision bearing.

In one embodiment, adjusting the alignment of the sample carrier axis prior to imaging, such as by using a tilt stage, greatly enhances the speed at which three dimensional images may be acquired. FIG. 6 depicts a flow chart of a method for pre-aligning a sample carrier prior to tomographic x-ray imaging. At block 350, the sample carrier is aligned. At block 352, an x-ray image of the sample is obtained. At decision block 354, it is determined if additional images at different sample angles are desired. If additional images are desired, the sample carrier is rotated a fixed amount at block 356. An additional image is then acquired at block 352. The process is repeated until all desired sample angles have been imaged. Computed tomography is then performed on all of the images obtained at different angles to construct a three-dimensional image of the sample at block 358.

The alignment process at block 350 may be conducted by imaging the sample carrier using optical microscopy, low dose x-ray microscopy, other microscopic technique, or a combination thereof. The alignment process may be conducted by rotating the sample carrier through several angles and adjusting the alignment until the axis of rotation does not change through the rotation, e.g., the sample carrier does not wobble excessively during rotation. In some embodiments, fiducial markers are included on the sample carrier. In one embodiment, the fiducial markers are mixed with the sample. In another embodiment, the fiducial markers are adhered to the sample carrier. For example, when the sample carrier is a capillary, the fiducial markers may be adhered to the interior surface of the capillary. In one embodiment, the fiducial markers are gold particles. In one embodiment, the fiducial markers may be markings manufactured or drawn onto the sample carrier. In some embodiments, alignment is conducted without the use of fiducial markers.

Alignment of the sample carrier using a tilt stage is illustrated in FIG. 7. Rotation motor 208 is coupled to precision bearing 210, which is coupled to tilt stage 212. In one embodiment, the tilt stage 212 comprises stationary platform 360 and tilt platform 362. Picomotors 364 and 366 are coupled to stationary platform 360 and operate to control the angle of tilt of tilt platform 362 relative to stationary platform 360. Sample carrier 216 is coupled to the tilt platform 362. Rotation motor 208 can induce rotation of the tilt stage 212 and the sample carrier 216 about axis of rotation 268. If the sample carrier 216 is not aligned with axis of rotation 268, than the sample carrier 216 wobbles or precesses about the rotation axis when it is rotated by rotation motor 208. Thus, for example, as depicted in FIG. 7, when sample carrier 216 is not aligned with axis of rotation 268 in the plane of the figure, then when the sample carrier 216 and tilt stage 212 are rotated 180 degrees, the rotated sample carrier 216' will form an angle θ relative to the position of un-rotated sample carrier 216. Alignment of the sample carrier 216 may be improved by then adjusting the angle of the tilt platform 362 using picomotors 364 and 366 by an amount of one half of θ in the plane of the figure. The process may be repeated in the plane perpendicular to the plane of the figure. Thus, the angle of tilt stage 212 can be adjusted independently in the plane of FIG. 7 and in the plane perpendicular to FIG. 7 and parallel to axis of rotation 268. Advantageously, the sample carrier 216 is aligned to be parallel or substantially parallel to the axis of rotation 268.

One embodiment of the alignment process is illustrated by the flow chart in FIG. 8. First, the sample carrier is imaged at 0 degrees rotation and at 180 degrees rotation using an optical microscope at block 400. The alignment of the sample carrier is adjusted at block 402 to counter any observed variation in the angle of the sample carrier between the two rotational orientations. Then, at block 404, the sample carrier is imaged using an optical microscope at 90 degrees rotation and 270 degrees rotation. The alignment of the sample carrier is again adjusted at block 406 to counter any observed variation in the angle of the sample carrier. The sample carrier is then imaged at 0 degrees rotation and 180 degrees rotation using an x-ray microscope. Alignment is adjusted at block 410 to counter observed variation. The sample carrier is imaged at 90 and 270 degrees of rotation using an x-ray microscope at block 412. Finally, alignment is again adjusted at block 414. When performing alignment using an x-ray microscope, it may be advantageous to use a low dose x-ray source. It should be appreciated that other angles than those mentioned may be used during the alignment procedure. In addition, the number of angles imaged may be increased and/or imaging at given angles repeated to enhance the accuracy of alignment.

In some embodiments, the alignment procedure is automated. For example, algorithms may be used to analyze the images of the sample carrier at various angles and then automatically adjust the tilt of the sample carrier. Fiducial markers on the sample carrier may aid such an automated process.

In one embodiment, once the sample carrier is aligned, alignment is maintained throughout rotation of the sample carrier during imaging through the use of a precision bearing. The precision bearing may be used to couple the rotation motor to the sample carrier, optionally through the tilt stage. In one embodiment, the precision bearing produces reproducible rotation to within about 80 nm. One embodiment of a precision bearing and associated components is depicted in FIG. 9. In this embodiment, the bearing 450 engages V-shaped conical depression 452 in support structure 454 to provide a precision rotation point. The bearing 450 is coupled to rotation motor 456. The rotation motor 456 and the support structure 454 are fixedly coupled to the same support structure 458. A U-shaped support structure 460 couples the bearing 450 and motor 456 to support structure 462, which is coupled to the tilt stage (e.g., the tilt stage 362 in FIG. 7), which is then coupled to the sample carrier (e.g., the sample carrier 216 in FIG. 7). The U-shaped support structure 460 transfers rotational motion from motor 456 to the sample carrier. Precision bearing 452 and depression 452 provide precise, reproducible rotation of the sample carrier.

The precision bearing of FIG. 9 does not allow for continuous 360 degree rotation of the sample carrier because U-shaped support structure 460 will impinge upon support structure 454. Thus, in another embodiment, a precision bearing is provided that allows for 360 degree continuous rotation of the sample carrier. One such bearing is depicted in FIG. 10. Bearings 470 and 472 engage V-shaped conical depressions 474 and 476, respectively, in support structures 478 and 480, respectively. Support structures 478 and 480 contain through holes in the narrowest portions of depressions 474 and 476 through which support structure 482 extends and couples bearings 470 and 472 together. The rotation motor 456 and the support structures 478 and 480 are fixedly coupled to the same support structure 458. The bearings 470 and 472 are coupled to rotation motor 456 and to support structure 462, which is coupled to the tilt stage (e.g., the tilt stage 362 in FIG. 7), which is then coupled to the sample carrier (e.g., the sample carrier 216 in FIG. 7). The precision bearing of FIG. 10 enables 360 degree continuous rotation of the sample carrier.

In one embodiment, the sample carrier is a capillary. The capillary may be manufactured by softening glass tubing and stretching the softened glass to from a thin capillary. The capillary may then be cut to the desired size. FIG. 11 depicts a capillary 500 positioned at the end of a glass tube 502. Glass tube 502 has diameter 504. Capillary 500 has diameter 508 and length 506. In one embodiment, diameter 504 is approximately 1 mm. In one embodiment, diameter 508 is approximately 10 microns. In one embodiment, length 506 is approximately 300 microns. In one embodiment, the diameter 508 is approximately equal to the diameter of cells that are to be imaged. Thus, a linear array of cells can fill capillary 500 for imaging. In one embodiment, capillary 500 (sample carrier) is sufficiently straight so that once it has been aligned, such as by the procedure described above, imaging along approximately 200 microns of the capillary sample carrier 500 can conducted without realignment. Thus, for example, the z stage on the x-ray microscope stage may be adjusted after a tomographic image acquisition in order to image a different region along the length of capillary 500 in a subsequent tomographic image acquisition. In one embodiment, samples are loaded into the capillary 500 by introducing them into glass tube 502 and then forcing the samples into capillary 500 such as by centrifugation or increased pressure. In another embodiment, samples are loaded into the capillary 500 by sucking the samples in through the capillary tip. In one embodiment, the capillary 500 and glass tube 502 are constructed of quartz glass. Other possible materials include Pyrex™ glass.

In one embodiment, the sample carrier is a substantially flat sample surface on which a sample can be placed. In one embodiment, the flat sample carrier comprises a silicon nitride substrate upon which the sample is placed. Advantageously, the flat sample carrier is constructed of an x-ray transparent material.

In one embodiment, a cooled gas is supplied to the sample carrier in order to freeze and/or keep the sample frozen at a desired temperature. In one embodiment, depicted in FIG. 12, a first gas 510 is cooled by passing through heat exchanger assembly 250 where the first gas 510 is in thermal contact with and exchanges heat with a second cooled gas 512. The first gas 510 is cooled and then flows through a gas outlet 218 and over sample carrier 520, which is coupled to the rest of the x-ray microscope stage 522. In one embodiment, the second cooled gas 512 is passed through the heat exchanger assembly 250 at a flow rate faster than the first gas 510 flow rate. The fast rate of flow of the second cooled gas 512 enables fast heat exchange. The slow rate of flow of the cooled first gas 510 prevents the sample from being disturbed by gas flow during imaging. The heat exchanger assembly 250 may comprise multiple heat exchangers 524 and 526. In FIG. 12 the heat exchanger 524 provides intermediate heat exchange and the heat exchanger 526 provides low temperature heat exchange. The heat exchanger may also include heaters for fine tuning of the temperature of the cooled first gas 510 flowing over the sample carrier 520. The second cooled gas 512 may be cooled by any suitable means. In one embodiment, the second cooled gas is cooled by passing it through liquid nitrogen. In another embodiment, the second cooled gas 512 is cooled by passing it through liquid helium or supercritical helium. In one embodiment, the second cooled gas 512 that flows through heat exchanger assembly 250 is nitrogen. In another embodiment, the second cooled gas 512 is helium. In one embodiment, the second cooled gas 512 flows through a loop, such that after heat exchange in the heat exchanger assembly 250, it returns to be re-cooled and then passed back to the heat exchanger assembly 250. In one embodiment, the cooled first gas 510 that flows over the sample carrier 520 is helium. In general any fluid that is a gas and not liquid at the cryo temperature of interest can be used as the first gas 510. When soft x-rays are used, it is especially important to consider how well the first gas 510 absorbs the soft x-rays. If the first gas 510 is good at absorbing soft x-rays, the quality of the x-ray imaging will be adversely affected. Absorption is less of an issue with hard x-rays as most gases suitable for use at cryo temperatures are not good at absorbing hard x-rays. For example, nitrogen gas at liquid nitrogen temperature can be used as the first gas 510 with hard x-rays

EXAMPLE 1

Imaging of *Saccharomyces cerevisiae*

The budding yeast, *Saccharomyces cerevisiae* was imaged using an x-ray microscope and a cyro tomographic microscope stage. *Saccharomyces cerevisiae* were grown with rotary shaking at 25 degrees C. in liquid YPD medium (1% yeast extract, 2% bapto peptone, and 2% glucose). Just prior to imaging, they were loaded into a 10 micron-diameter capillary from the beveled tip end of the capillary using an Eppendorf microinjection apparatus. The yeast were examined in a light microscope then rapidly frozen with a blast of liquid nitrogen cooled helium gas and placed in the x-ray microscope stage.

A soft x-ray source generated by a bend magnet at the Advanced Light Source at Lawrence Berkeley National Laboratory was used. A Fresnel zone plate having 9 mm diameter with an outermost zone width of 55 nm and a focal length of 205 mm at 517 eV photon energy was used as a condenser. A Fresnel zone plate having a 40 micron diameter, within outermost zone width of 35 nm and a focal length of 650 microns at 517 eV photon energy was used as an objective lens.

The sample capillary was aligned using microscopic imaging and a tilt stage with picomotors. 45 images were then collected through 180 degrees of rotation. The images were detected on a Peltier-cooled back-illuminated, 1024×1024 soft x-ray CCD camera. Three dimensional volume reconstruction was performed using weighted, filtered back projection. Surface reconstruction and volume segmentation and rendering were performed using AmiraDev 3 software.

FIG. 13A depicts a three dimensional volume reconstructed image of one cell displaying a translucent outer surface and opaque surfaces to highlight internal organelles. FIG. 13B depicts a volume rendered surface view of the cell. FIG. 13C depicts a cross section of the cell. The arrow in each image highlights the cell's nucleus. FIGS. 14A through 14F depict cross sections of a budding cell at various depths through the cell.

INDUSTRIAL APPLICABILITY

Figure 1:
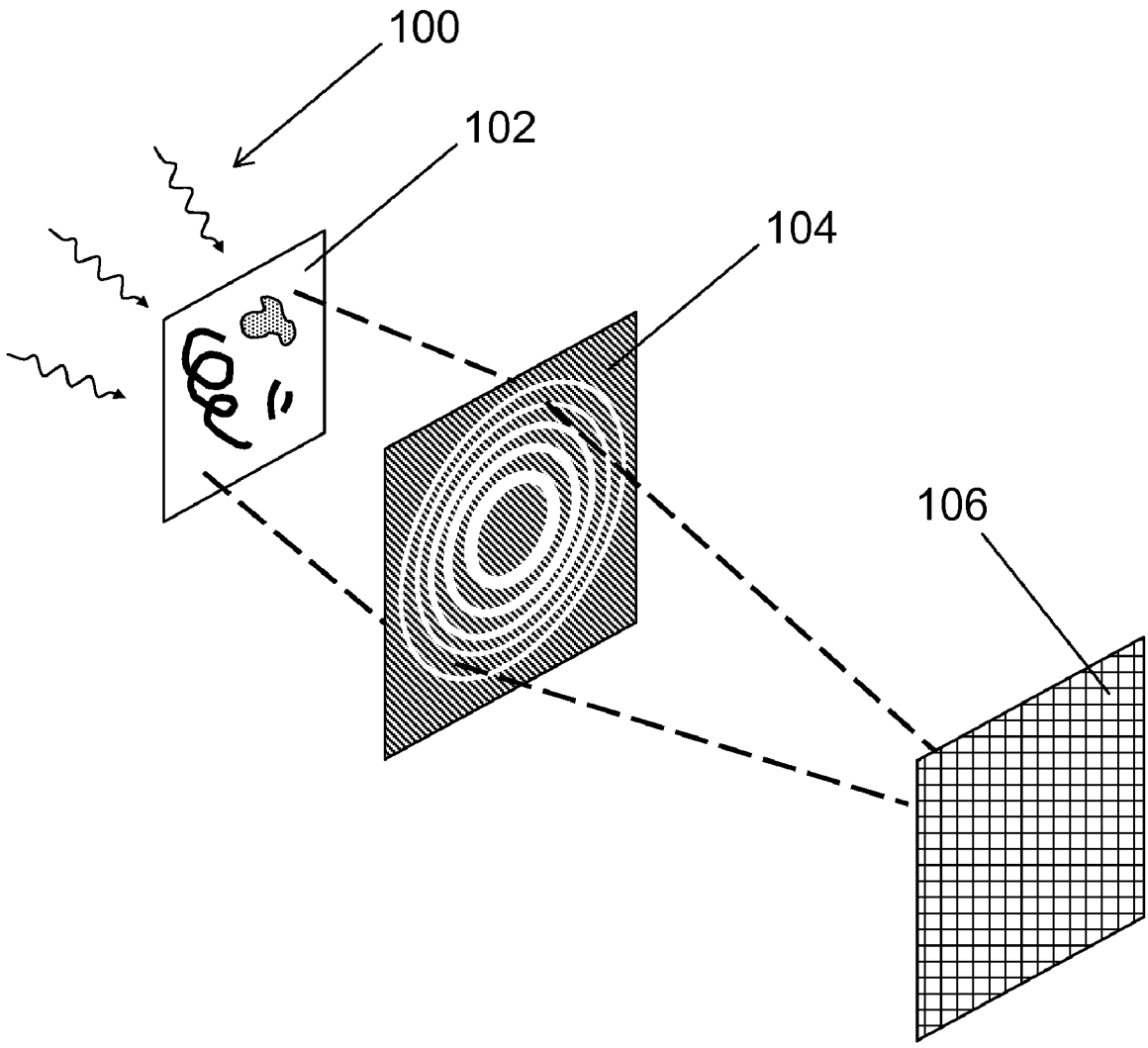
FIG. 1 is a schematic of typical transmission x-ray microscope components.
Figure 2:
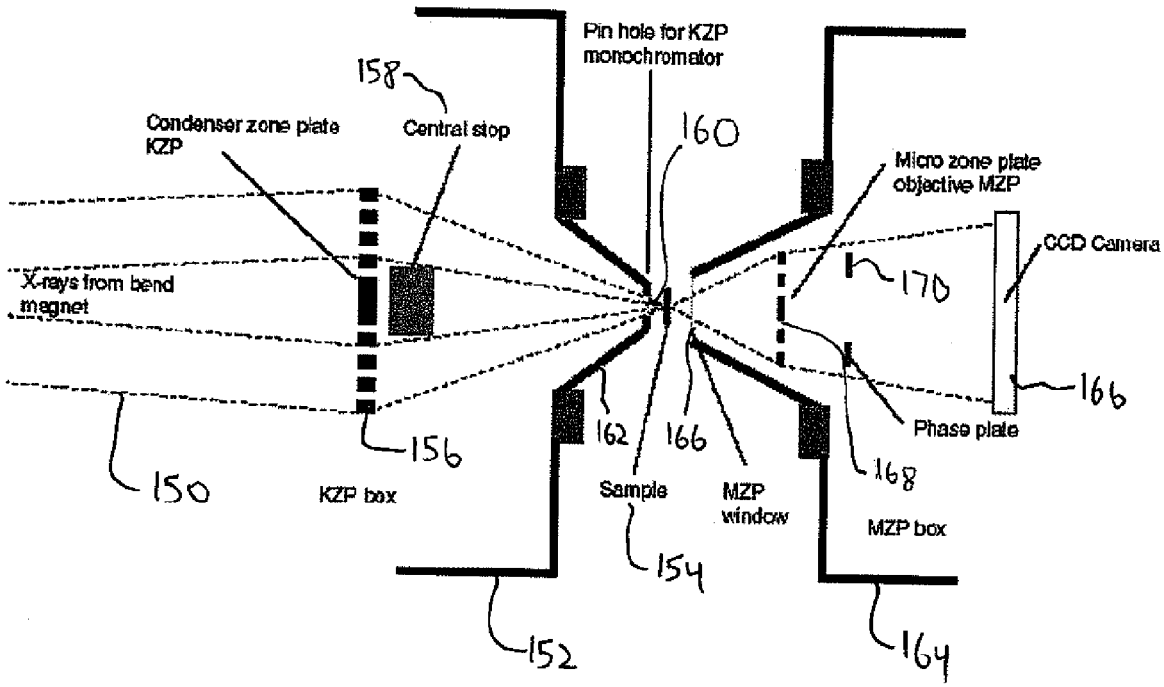
FIG. 2 depicts an x-ray microscope.
Figure 3:
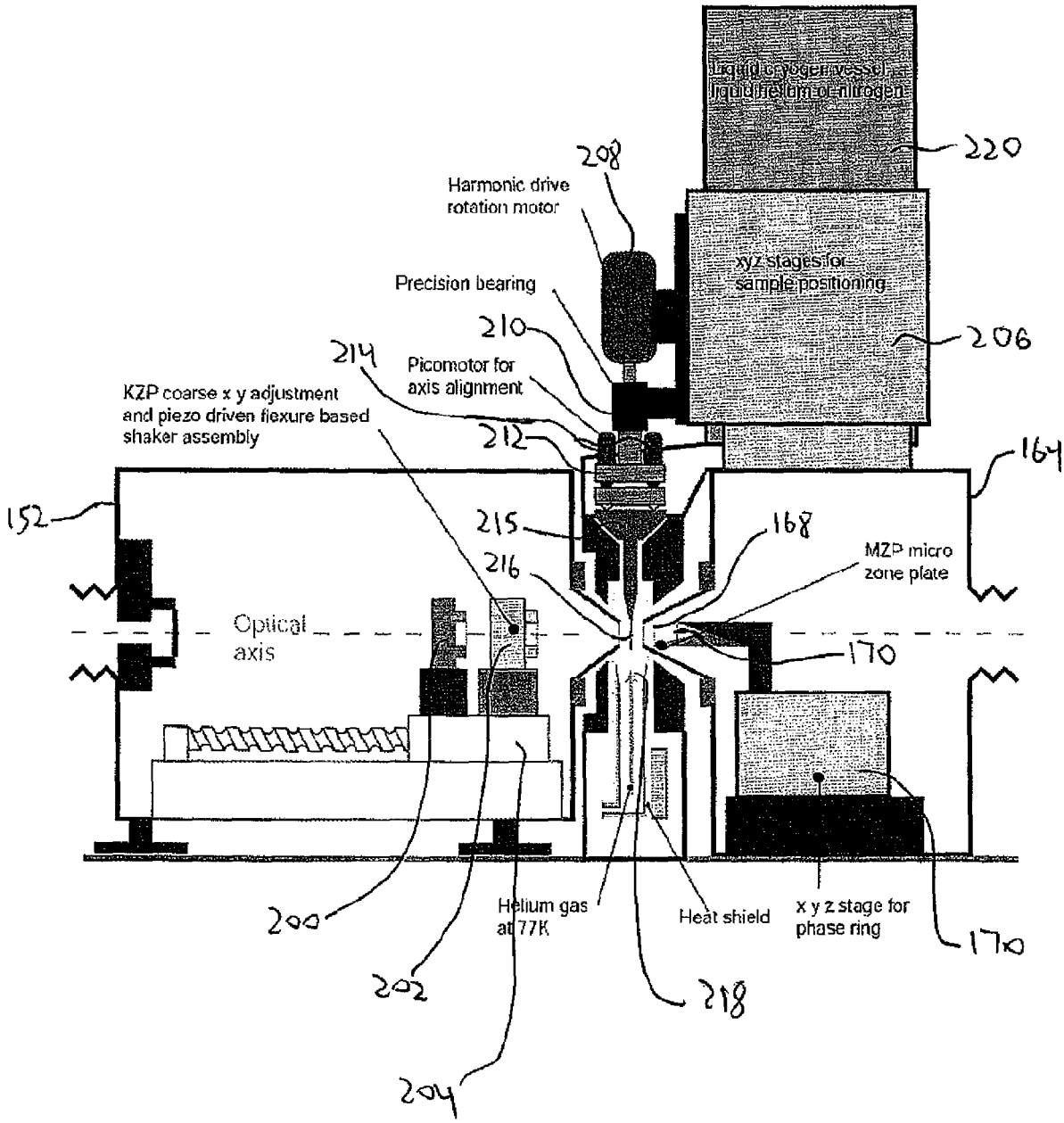
FIG. 3 depicts an x-ray microscope in conjunction with an x-ray microscope stage.
Figure 4:
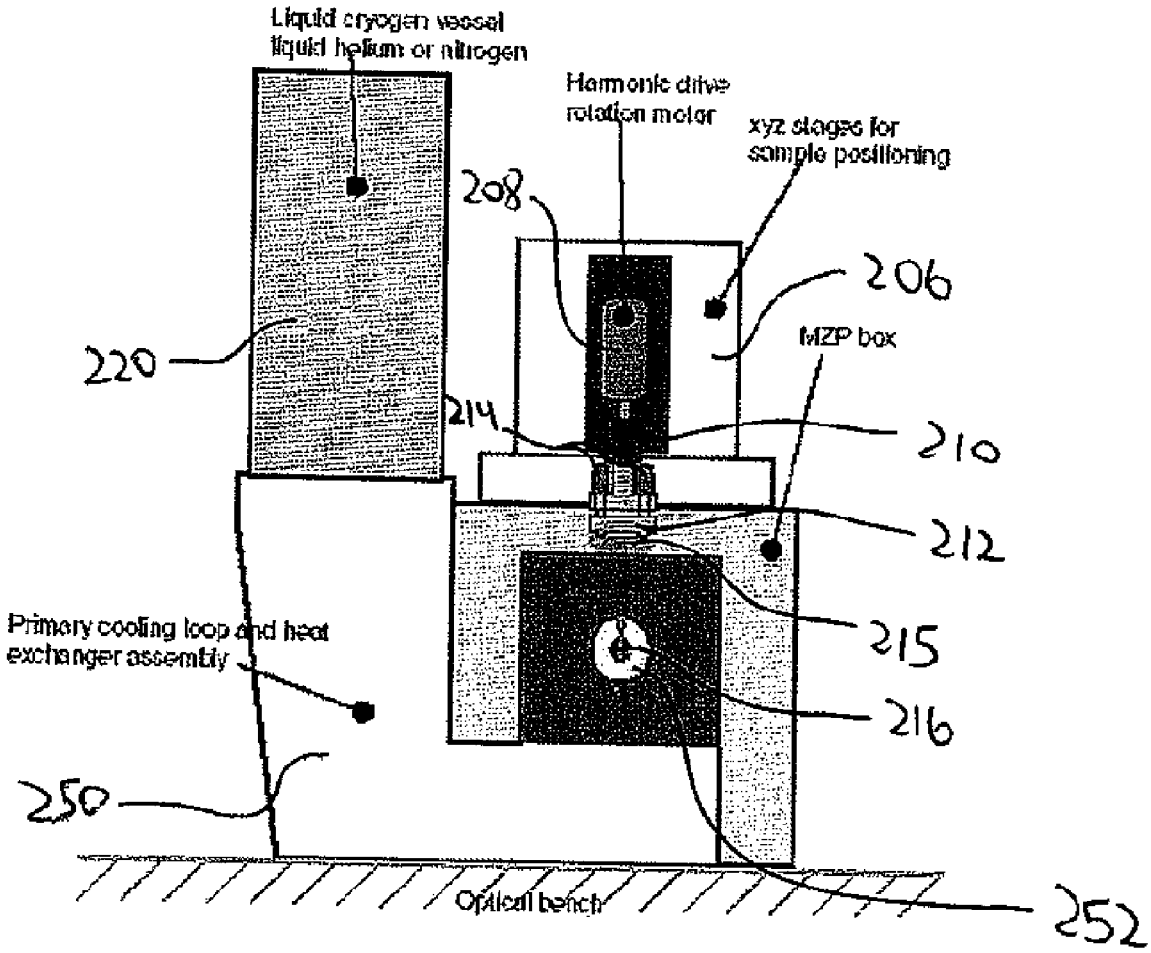
FIG. 4 depicts an x-ray microscope stage.
Figure 5:
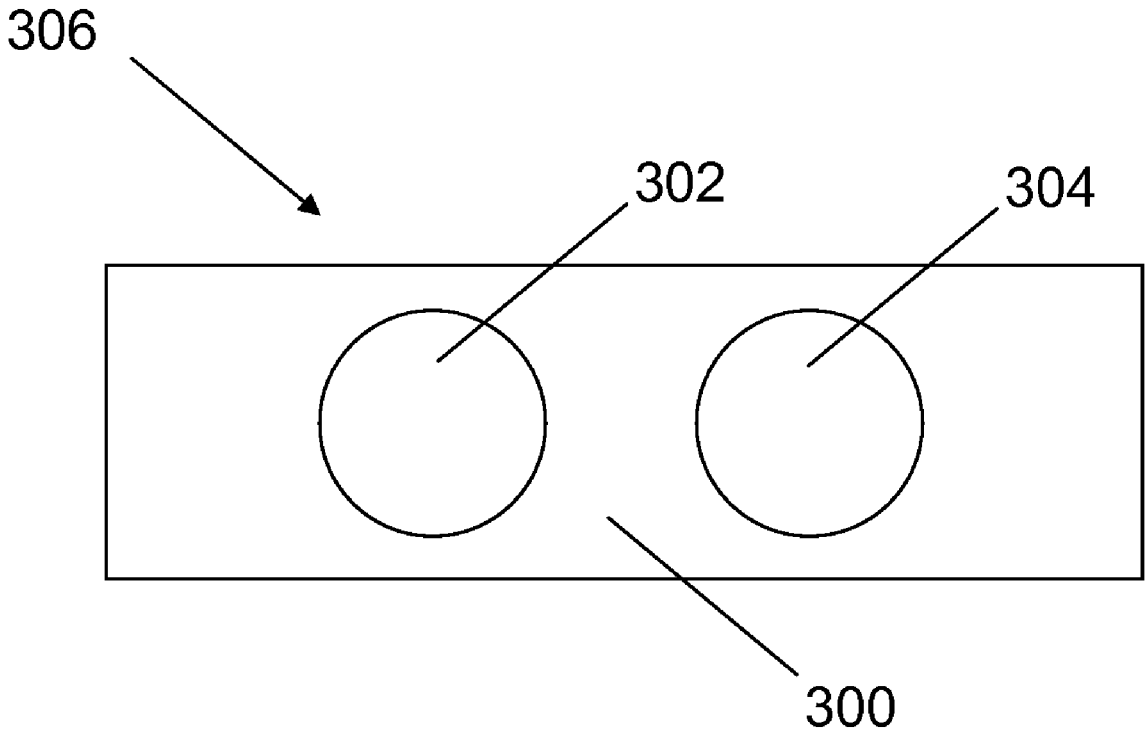
FIG. 5 depicts a window selector for use on an x-ray microscope stage.
Figure 6:
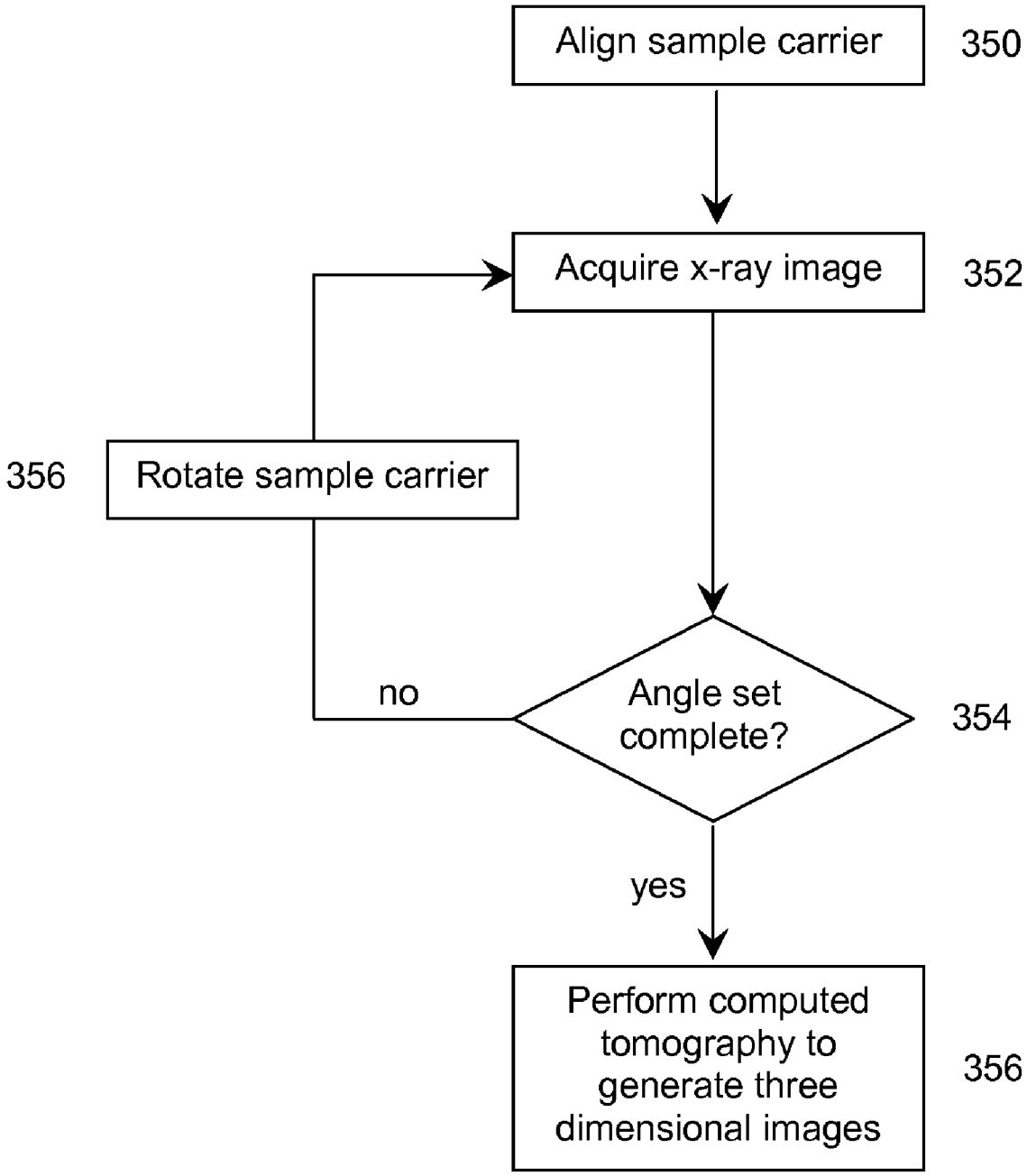
FIG. 6 is a flowchart illustrating a tomographic x-ray microscopy technique.
Figure 7:
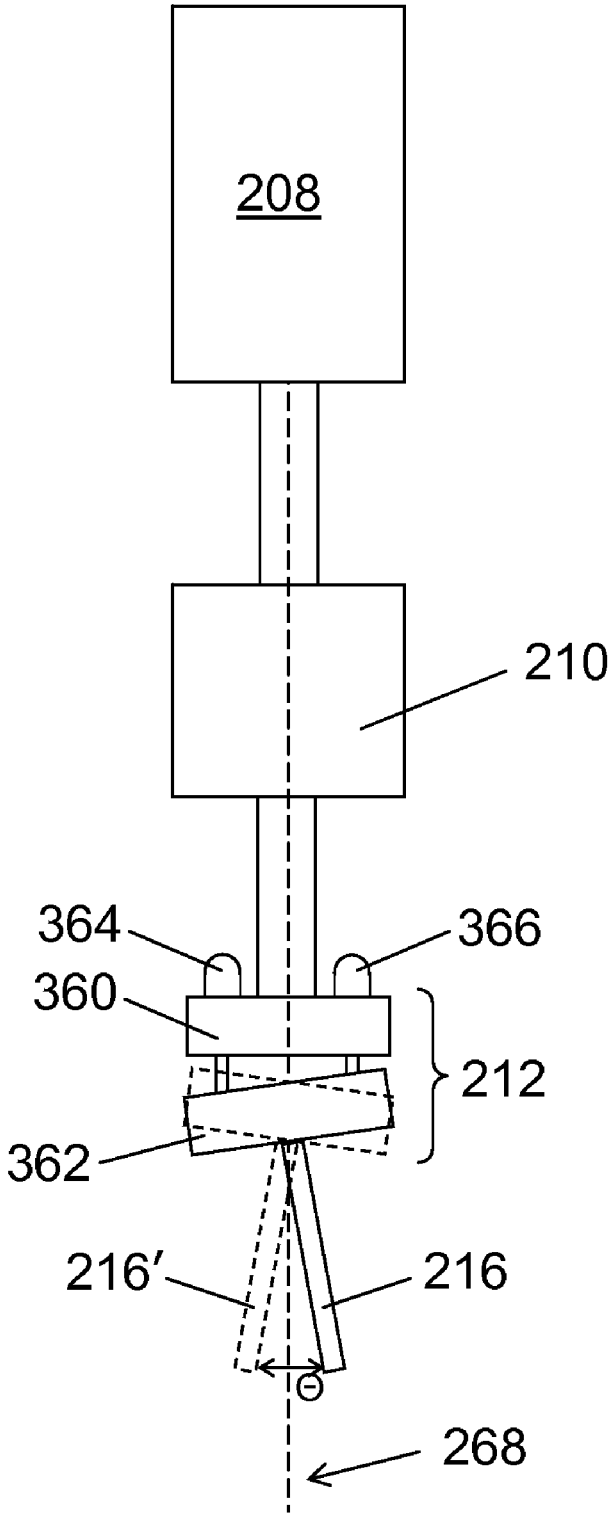
FIG. 7 depicts an x-ray microscope stage comprising a tilt stage that can be used to align a sample carrier relative to an axis of rotation.
Figure 8:
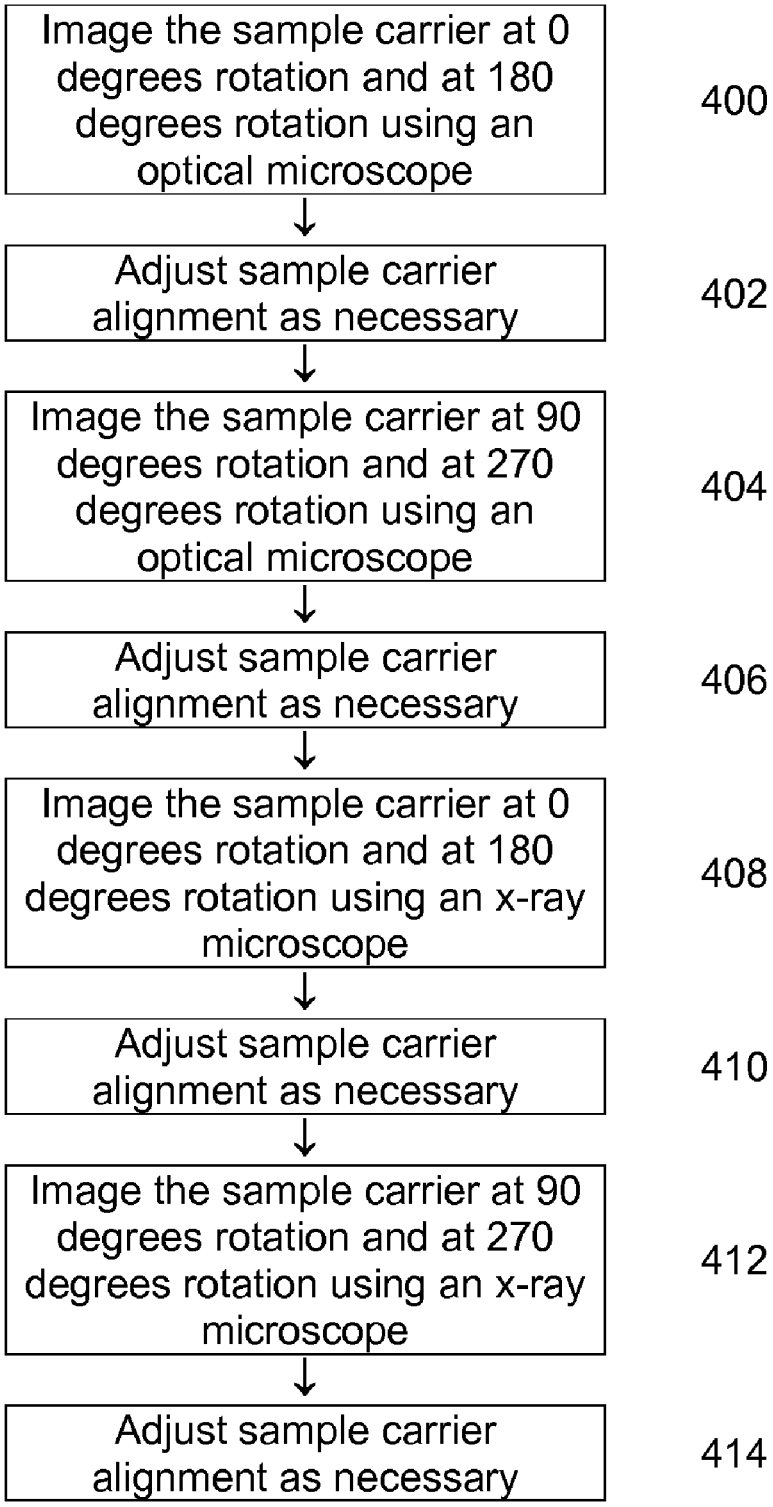
FIG. 8 is a flowchart illustrating a procedure for aligning a sample in an x-ray microscope stage.
Figure 9:
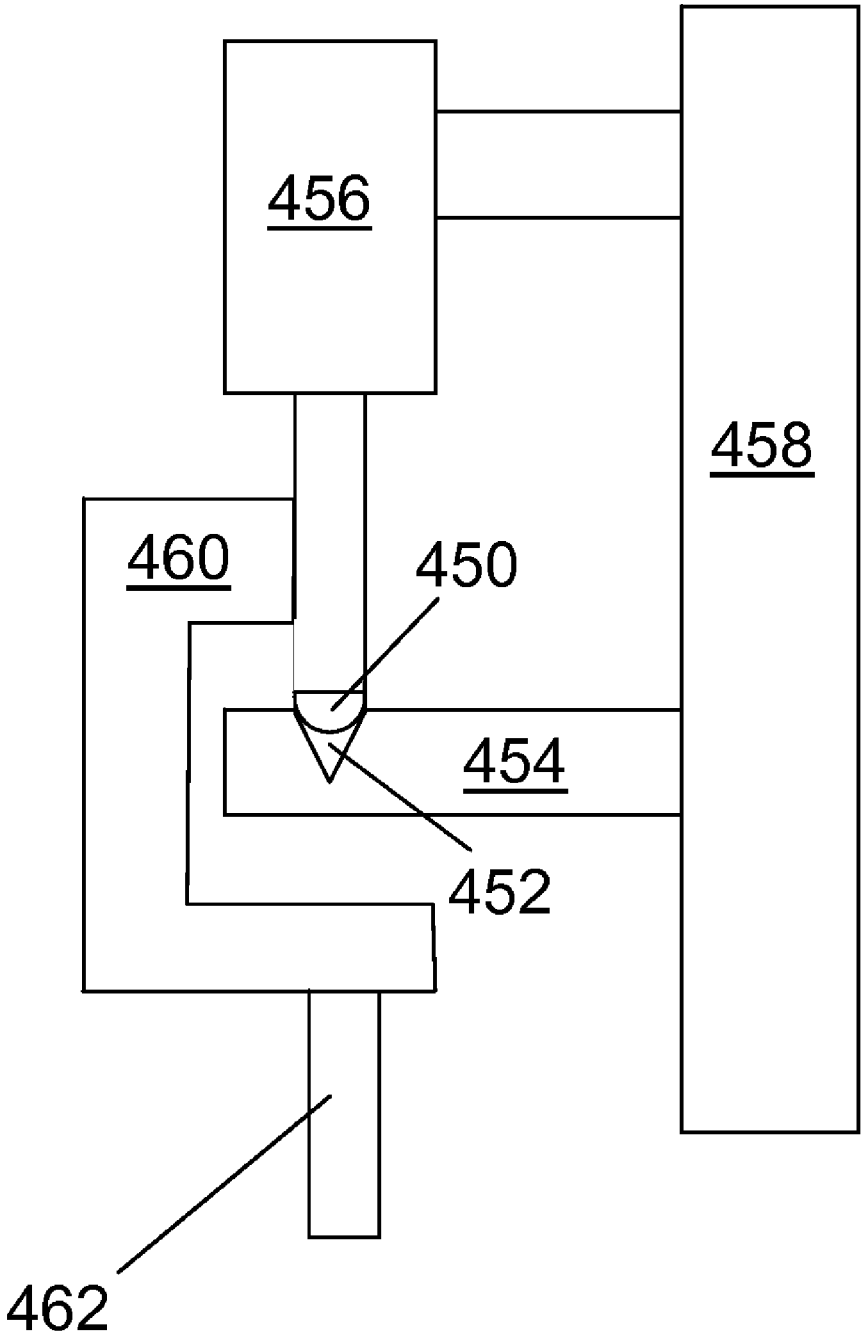
FIG. 9 depicts a precision bearing for an x-ray microscope stage.
Figure 10:
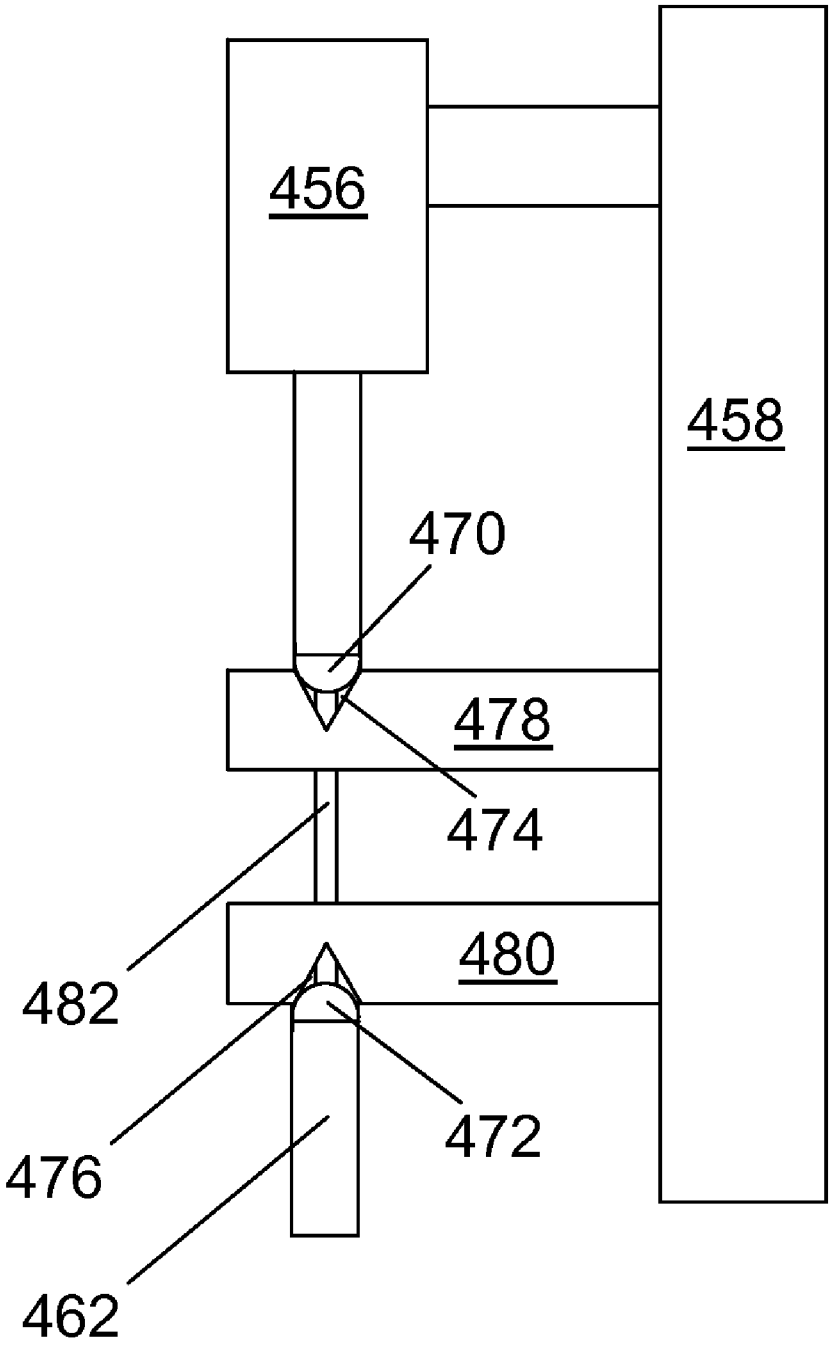
FIG. 10 depicts a precision bearing for an x-ray microscope stage that allows 360 rotation of the sample.
Figure 11:
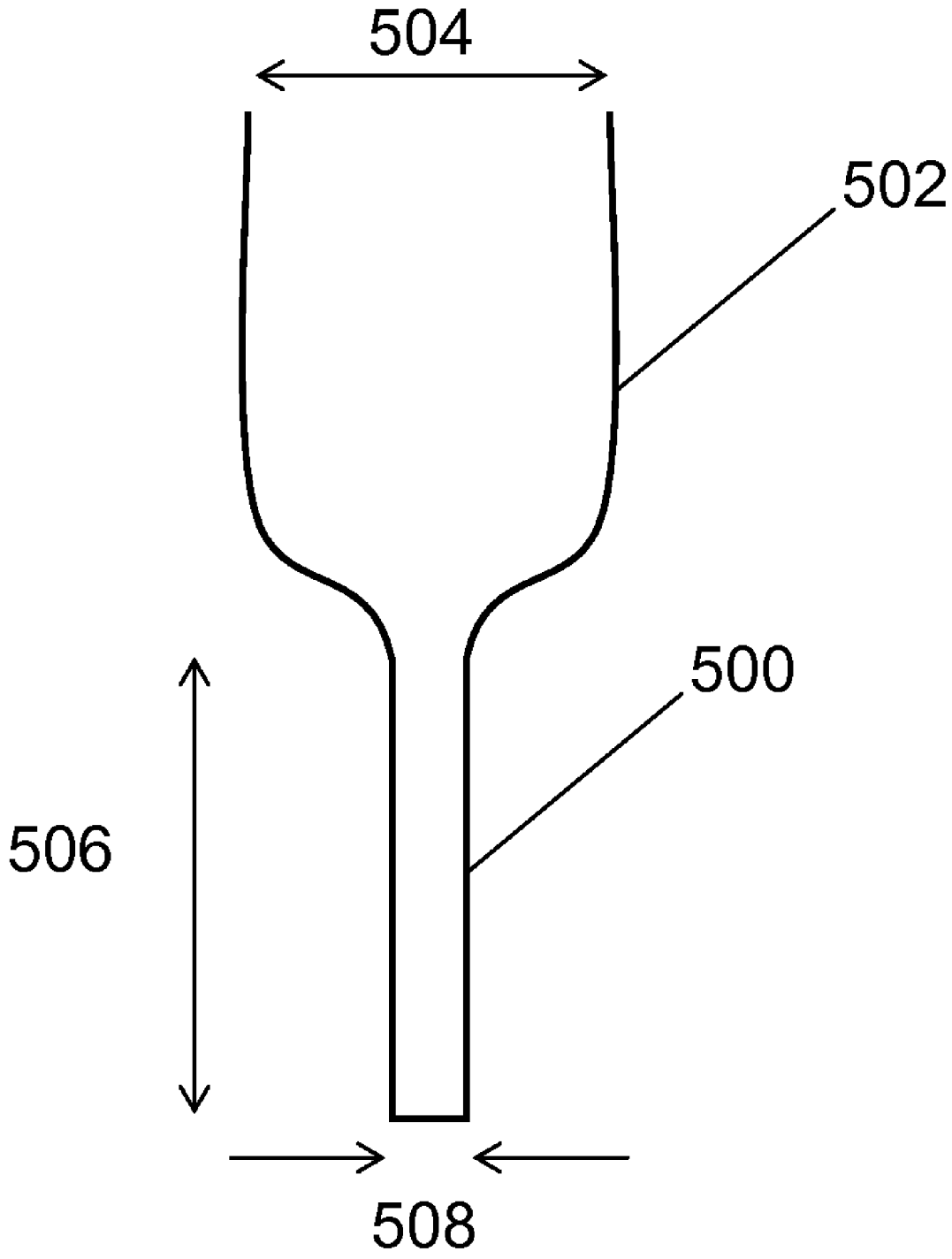
FIG. 11 depicts a capillary for holding samples for x-ray imaging.
Figure 12:
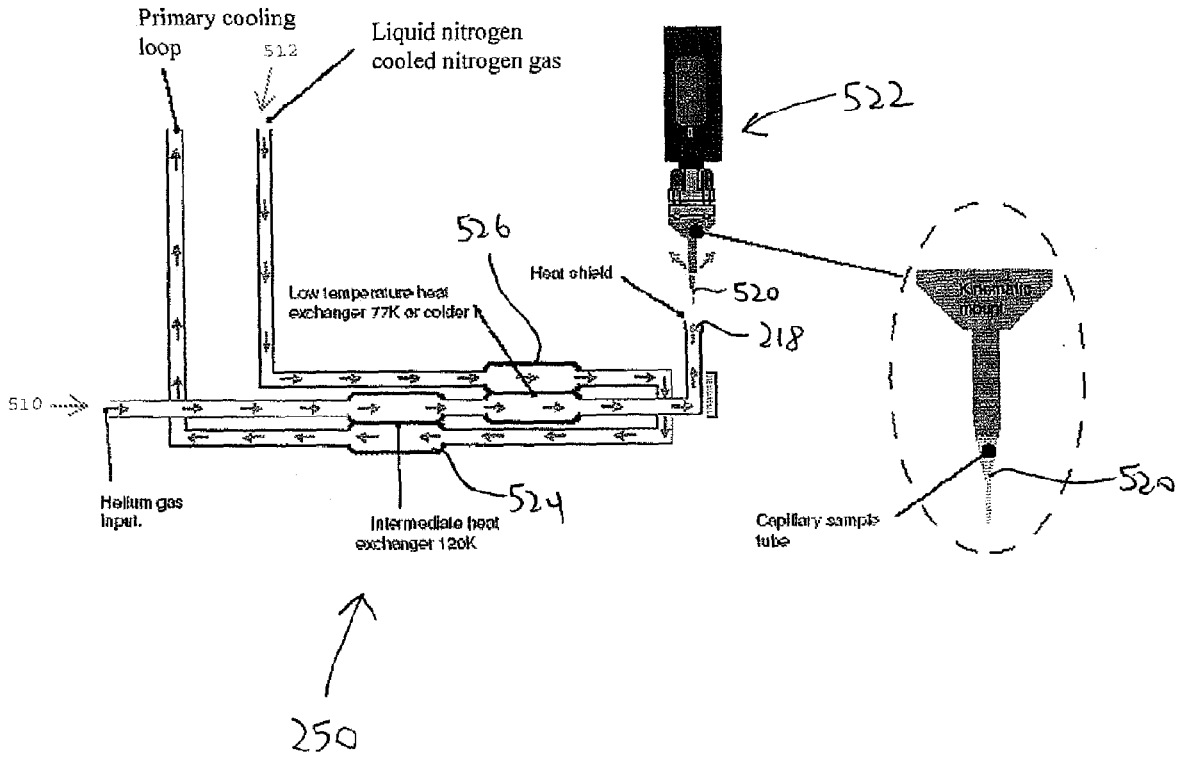
FIG. 12 depicts a heat exchanger assembly for cooling a gas for use in cooling a sample during x-ray microscopy.
Figure 13:
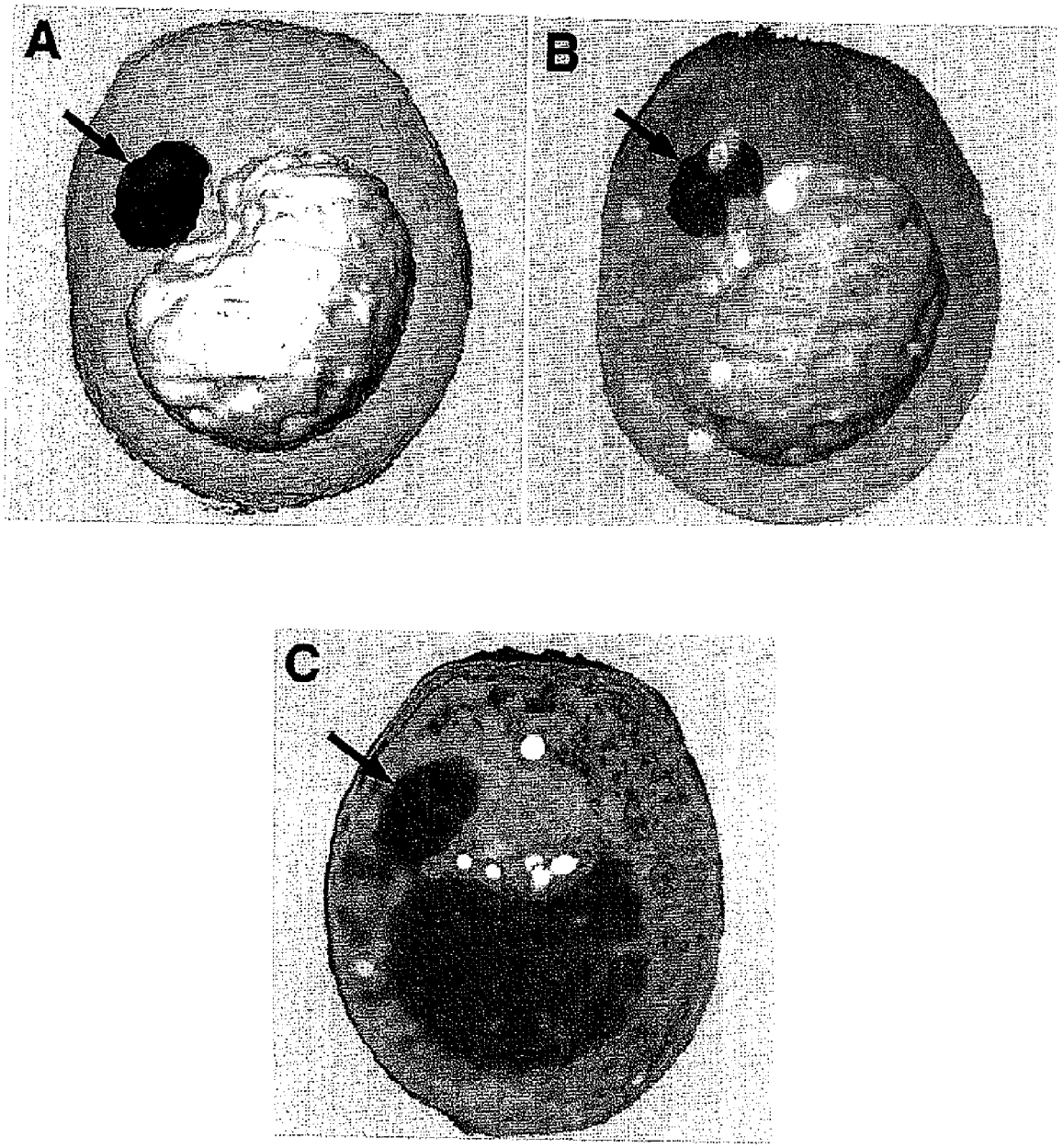
FIG. 13 depicts three-dimensional images of a cell obtained using an x-ray microscope.
Figure 14:
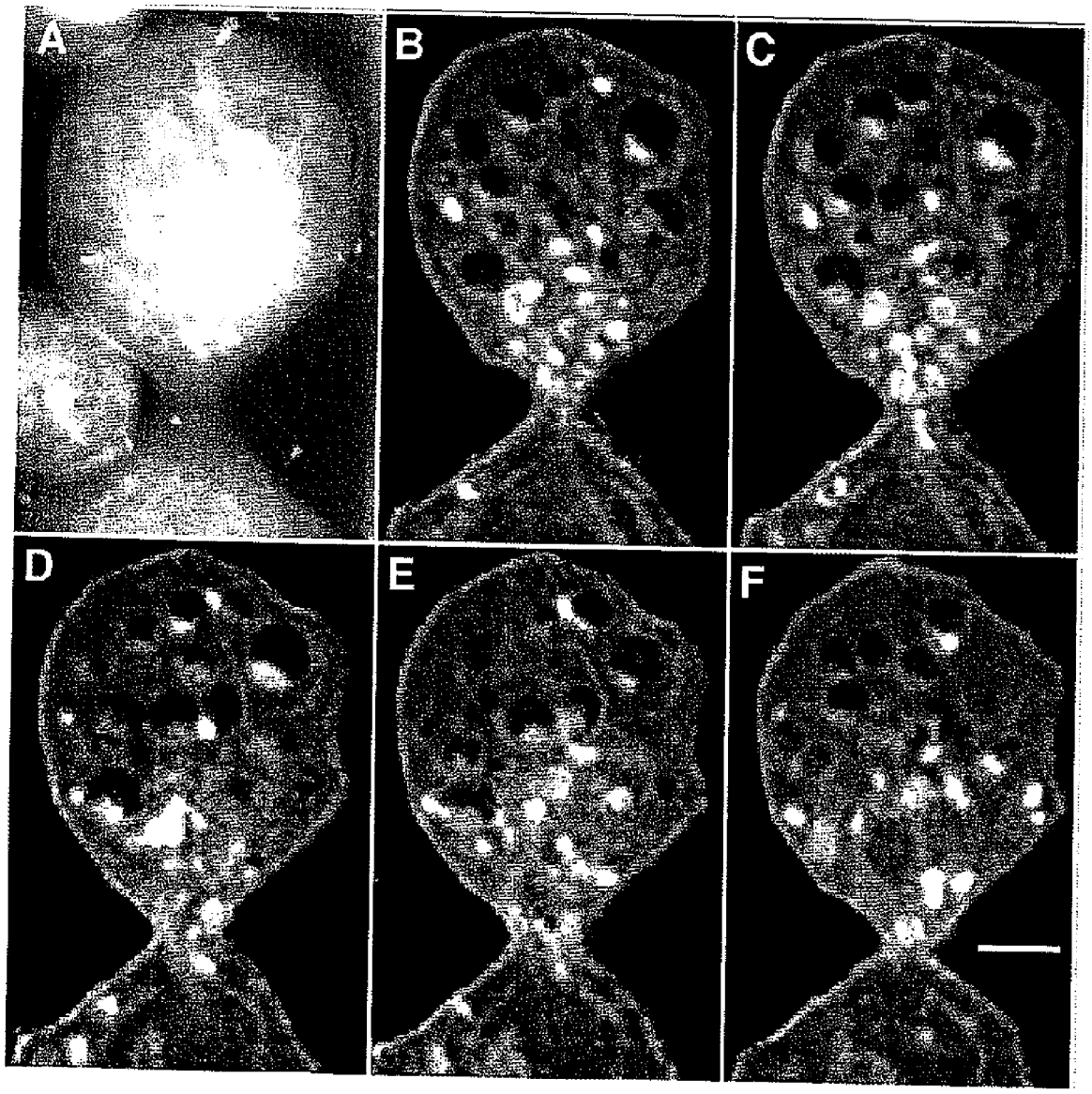
FIG. 14 depicts cross-sectional images of a cell obtained using an x-ray microscope.

Tomography can accomplished with x-ray microscopy by taking a series of images at different sample tilt angles. In order for the computed tomography algorithms to function properly, the images must be aligned relative to the same rotation axis. Previously, such alignment has been accomplished by either re-aligning the sample between each image or by including fiducial markers with the sample and then using a 3D marker module to align the images. However, these techniques require tedious and time-consuming manual procedures and may introduce additional error into the resulting image. Fast and automated sample alignment for tomographic x-ray microscopy can be provided by the embodiments of the invention disclosed herein.

One aspect of the present invention is an x-ray microscope stage, comprising a sample holder or carrier, one or more tilt motors coupled to the sample holder and adapted to tilt the sample holder relative to a first axis, and a rotation motor coupled to the sample holder and adapted to rotate the sample holder around a second axis that is parallel or substantially parallel to the first axis.

Another aspect of the present invention is a cryogenic x-ray microscope stage, comprising a gas outlet for providing a flow of a first cooled gas to a sample to be imaged by an x-ray microscope, and a heat exchanger coupled to the gas outlet for transferring heat from the first cooled gas to a second cooled gas, wherein the second cooled gas flows through the heat exchanger at a rate faster than the first cooled gas.

Another aspect of the present invention is a x-ray microscope stage, comprising a means for holding a sample, a means for tilting the sample relative to a first axis, and a means for rotating the sample around a second axis that is parallel or substantially parallel to the first axis.

Another aspect of the present invention is a method of imaging a sample, comprising aligning a sample holder or carrier containing the sample relative to an axis; after the aligning, repeatedly collecting images using x-rays that are passed through the sample at a plurality of angles relative to the sample, the angles perpendicular or substantially perpendicular to the axis, wherein the sample holder or carrier is not re-aligned between collecting each image, and performing computed tomography on the images obtained in order to construct a three-dimensional image of the sample. In some arrangements, the plurality of angles are obtained by rotating the sample about the axis. The aligning step can include imaging at least a portion of the sample holder through a visible light microscope. In another embodiment, the aligning step can include imaging at least a portion of the sample holder with an x-ray microscope. In another embodiment, the aligning step can include imaging fiducial markers in the sample holder. The fiducial markers can be gold particles and the gold particles can be mixed in the sample in the sample holder or the markers can be on the outside of the sample holder. The gold particles can be adhered to the surface of at least a portion of the sample holder.

We claim:

1. An x-ray microscope stage, comprising:

a sample holder;

a rotation motor coupled to the sample holder and adapted to rotate the sample holder around an axis of rotation;

one or more tilt motors coupled to the sample holder and adapted to adjust a tilt angle of the sample holder relative to the axis of rotation; and a cryogenic gas outlet for providing a flow of a first cryogenic gas to the sample holder.

2. The stage of claim 1, wherein the rotation motor is coupled to the sample holder via a bearing.

3. The stage of claim 1, wherein the sample holder comprises a capillary to hold a sample.

4. The stage of claim 1, wherein the first cryogenic gas is cooled by flowing through a heat exchanger that is in thermal contact with a second cryogenic gas, the second cryogenic gas at a lower temperature than the first cryogenic gas.

5. The stage of claim 4, wherein the second cryogenic gas flows through the heat exchanger at a faster rate than the first cryogenic gas flows through the heat exchanger.

6. The stage of claim 4, wherein the first cryogenic gas and the second cryogenic gas are each selected from the group consisting of helium and nitrogen.

7. The stage of claim 4, wherein the second cryogenic gas is cooled by passing through liquid nitrogen or supercritical helium.

8. The stage of claim 1, further comprising a window slide assembly adjacent the sample holder, the window slide assembly comprising a plurality of windows, wherein each of the windows are selectably positioned for imaging of a sample therethrough.

9. The stage of claim 8, wherein the window slide assembly comprises a window for imaging with an x-ray source and a window for imaging with a visual light source.

10. A cryogenic x-ray microscope stage, comprising:

a first heat exchanger assembly through which a first cryogenic gas flows;

a gas outlet at an end of the first heat exchanger assembly, the gas outlet configured to provide flow of a first cryogenic gas to a sample to be imaged by an x-ray microscope; and a second heat exchanger assembly through which a second cryogenic gas flows, the second heat exchanger assembly coupled to the first heat exchanger assemble to allow heat exchange between the first cryogenic gas in the first heat exchanger assembly and the second cryogenic gas in the second heat exchanger assembly.

11. The stage of claim 10 wherein the second cryogenic gas flows through the second heat exchanger assembly at a rate faster than the first cooled cryogenic gas flows through the first heat exchanger assembly.

12. The stage of claim 10, wherein the first cryogenic gas and the second cryogenic gas are each selected from the group consisting of helium and nitrogen.

13. A method of imaging a sample, comprising the steps of:

a) placing a sample in a sample holder;

b) aligning the sample holder relative to an axis;

c) after the aligning, repeatedly collecting images using x-rays that are passed through the sample at a plurality of angles relative to the sample, the angles perpendicular or substantially perpendicular to the axis, wherein the sample holder is not re-aligned after collecting each image; and d) performing computed tomography on the images to construct a three dimensional image of the sample.

14. The method of claim 13, wherein the aligning step comprises imaging at least a portion of the sample holder through a visible light microscope.

15. The method of claim 13, wherein the aligning step comprises imaging at least a portion of the sample holder with an x-ray microscope.

16. The method of claim 13, wherein the aligning step comprises imaging fiducial markers in the sample holder.

17. The method of claim 13, wherein the plurality of angles are obtained by rotating the sample.

18. A method of imaging a sample, comprising the steps of:

a) using an automated system to align a sample along an axis in a first sample position;

b) irradiating the sample with x rays a first time and collecting a first x-ray image of the sample;

c) rotating the sample about the axis to a Previously presented sample position;

d) irradiating the sample with x rays again and collecting another x-ray image of the sample;

e) without re-aligning, repeating steps c and d until a desired number of x-ray images are collected; and f) using computed tomography to process the desired number of x-ray images and to create a three dimensional image of the sample.

19. A method of aligning a sample along a rotation axis comprising the steps of:

a) providing a sample carrier at about 0° rotation;

b) making a first image of the sample carrier;

c) rotating the sample carrier to about 180° rotation;

d) making a second image of the sample carrier;

e) studying the first image and the second image to determine whether there is an angle Θ between positions of the sample carrier in the images;

f) tilting the sample carrier by an angle equal to half Θ toward the rotation axis to adjust alignment of the sample carrier;

g) providing a sample carrier at about 90° rotation;

h) making a third image of the sample carrier;

i) rotating the sample carrier to about 270° rotation;

j) making a fourth image of the sample carrier;

k) studying the third image and the fourth image to determine whether there is an angle Θ between positions of the sample carrier in the images; and

1) tilting the sample carrier by an angle equal to half Θ toward the rotation axis to adjust alignment of the sample carrier.

20. The method of claim 19 wherein making an image comprises using light and an optical microscope to make the image.

21. The method of claim 20, further comprising, after completing steps a-1, repeating steps a-1 using x rays and an x-ray microscope in the making the image steps.

22. The method of claim 19 wherein making an image comprises using x rays and an x-ray microscope to make the image.

23. The method of claim 19 wherein the method is automated.

* * * * *